US007275949B1

(12) United States Patent
Speaker, IV

(10) Patent No.: US 7,275,949 B1
(45) Date of Patent: Oct. 2, 2007

(54) HIGHLY MOISTURE RESISTANT COUPLER SYSTEM FOR COMMUNICATIONS AND ELECTRICAL CONNECTIONS

(75) Inventor: Theordore J. Speaker, IV, Alstead, NH (US)

(73) Assignee: Whitney Blake Company, Bellows Falls, UT (US)

( * ) Notice: Subject to any disclaimer, the term of this patent is extended or adjusted under 35 U.S.C. 154(b) by 0 days.

(21) Appl. No.: 11/638,233

(22) Filed: Dec. 14, 2006

(51) Int. Cl.
*H01R 13/52* (2006.01)

(52) U.S. Cl. ..... 439/271; 439/278; 439/349

(58) Field of Classification Search ..... 439/274, 439/275, 349, 278, 271, 281, 279
See application file for complete search history.

(56) References Cited

U.S. PATENT DOCUMENTS 1,871,391 A * 8/1932 Robson ..... 72/288
7,150,642 B1 * 12/2006 Bakke et al. ..... 439/271
7,182,617 B1 * 2/2007 Cairns et al. ..... 439/271

* cited by examiner

*Primary Examiner*—Hae Moon Hyeon
(74) *Attorney, Agent, or Firm*—Stephen W. White

(57) ABSTRACT

A coupling system that forms a moisture resistant shield around connectable elements comprising a male element containing female connection points inserted into a female element containing male connection points. These made from rigid and thermoplastic materials. This system has a series of rings on the female element and grooves on the male element. These grooves mate to form a first moisture barrier and a rigid lip on the male element circumferentially surrounding the female connection points, presses into a flexible face containing the male connection points on the female element to form yet another moisture barrier. This system can be easily be connected, disconnected and reconnected a plurality of times and yet the highly moisture resistant seal is repeated. It finds good use in communications or electrical connections among others.

7 Claims, 7 Drawing Sheets

HIGHLY MOISTURE RESISTANT COUPLER SYSTEM FOR COMMUNICATIONS AND ELECTRICAL CONNECTIONS

CROSS-REFERENCE TO RELATED APPLICATIONS

This application is related to my previously filed application U.S. Ser. No. 11/438,153, filed May 22, 2006, now abandoned, with the same subject and is a continuation thereof.

BACKGROUND OF THE INVENTION

1. Field of the Invention

This invention relates to the field of elements that can be used to make line to line connections for communications, electrical and other transmission systems. Still further this invention relates to such connecting elements that are highly moisture resistant. More specifically, this invention relates to highly moisture resistant connections made using male to female coupling elements. Still more specifically, this invention relates to such male and female highly moisture resistant coupling elements that can be easily connected and subsequently disconnected a plurality of times while maintaining connectablity, circuit and communications continuity and high resistance to moisture with each re-connection.

2. Description of the Prior Art

There is a pressing need within the communications, electrical and other fields to have a highly moisture resistant coupling system so that systems connections are protected under adverse conditions and furthermore whereby systems can be changed at will in order to meet the requisite need of changing components, adding further lines or for a wide range testing purposes, for example. There are a host of prior art references that describe coupling elements that are said to be useful within these fields. Many of these prior art references are also said to be moisture resistant but most of these are highly complicated elements that require a host of parts, some of which are movable. Thus, these complicated elements cannot be said to be highly moisture resistant especially after a plurality of connections and disconnections. One particular prior art element claims a water resistant electrical connector comprising both male and female connecting elements wherein the male comprises an articulating means for establishing a water-resistant seal and the female element is designed to slidably engage the male element using a cylindrical sleeve and wherein a series of balls on the male element are designed to engage the cylindrical sleeves so as to form a water-resistant element. This is a very complicated system and since the balls are movable within the system over time the resistance to water will be lessened as the system is connected and subsequently reconnected.

Some prior art connections are made so as to be highly resistant to disconnection and subsequent reconnection so as to maintain an almost absolute resistant to moisture and water. These can only be unconnected in a complicated procedure using tools and the like and are therefore meant to be almost a permanent connection. These elements are not particularly useful within the field of this invention where such connections and subsequent disconnections are highly desirable.

Still other prior art systems are even more complicated and require even more parts in their attempt to ensure a complete and water resistant closing. These prior art elements are said to be a water resistant connector for joining two cable ends but is comprised of a myriad of parts and locking elements and covering sleeves such as to be impractical for easy coupling and uncoupling.

Another prior art device said to provide moisture resistant electrical connection provides a pair of connecting elements one of which is tapered to fit within the other. This device is made of resilient rubber and offers a ring and groove arrangement in an attempt to ensure good water resistance. This device lacks any other means to provide water resistance and, after a period of time and many connects and disconnects, tends to leak badly.

Still yet another prior art device offers a pair of connectors one of which must be screwed into the other in order to provide intimate contact and to assist in providing moisture resistance. This element cannot support more than one line since the elements rotate one against the other and in addition over time have a propensity to leak.

Thus, there is a pressing need within the art field of electrical, communications and other cables or transmission systems to provide a safe and highly moisture resistant coupling device that will permit the user to easily and quickly connect and disconnect electrical, communication or other lines or devices a plurality of times and without compromising system integrity or high moisture resistance with each subsequent reconnection.

SUMMARY OF THE INVENTION

It is an object of this invention to provide a safe and highly moisture resistant coupling device for electrical, communication and other systems. It is yet another object of this invention to provide such a device that can be easily connected and disconnected without either decreasing the moisture resistance of said device or impacting the use therefore. These and yet other objects are achieved in a highly moisture resistant flexible coupler system having two coupling elements therein comprising;

a. a first male coupling element formed in a longitudinal end-to-end formation and having an energy transmitting line element contained and encapsulated therein, comprising in order a first end comprising said line for transmitting said energy, an encapsulated gripping element and a second end formed longitudinally into a circular body, said circular body comprising an outer layer and an encapsulating inner layer, at least one female receiving element being encapsulated longitudinally therein, said female receiving element having two ends, one of said ends being connected to said energy transmitting line and the other of said ends terminated near a face ended on said circular body, wherein a rigid lip is formed circumferentially on said face, and wherein the outer layer of said circular body has at least two grooves formed circumferentially thereon;

b. a second female coupling element formed in a longitudinal end-to-end formation and having an energy transmitting line element contained and encapsulated therein, comprising in order a first end and a second end, said first end having a hollow, flexible, circular sleeve, circumferentially containing at least one longitudinal male connecting element, said flexible, circular sleeve formed in a manner so as to receive said circular body from said male coupling element, and having at least two rings formed circumferentially inside around said male connecting element, said male connecting element longitudinally connected at a face to a second energy transmission line encapsulated in a second gripping element and forming said second end;

so that when said circular body from said male coupling element is inserted in said circular sleeve from said female coupling element, said male connecting element in said female coupling element fits within said female connecting element in said male connecting element, said rings of said female connecting element fits within said grooves in said male connecting element and said face of said female connecting element firmly contacts and seals said rigid lip of said face of said male connecting element and energy transmission is completed from said male to said female connecting element.

BRIEF DESCRIPTION OF THE DRAWINGS

Although these drawings show the best mode of this invention at the time of filing they are not meant to restrict the invention to the specific elements contained therein. Other embodiments will be obvious to all from the details and descriptions that follow.

DETAILS OF THE INVENTION

Figure 1:
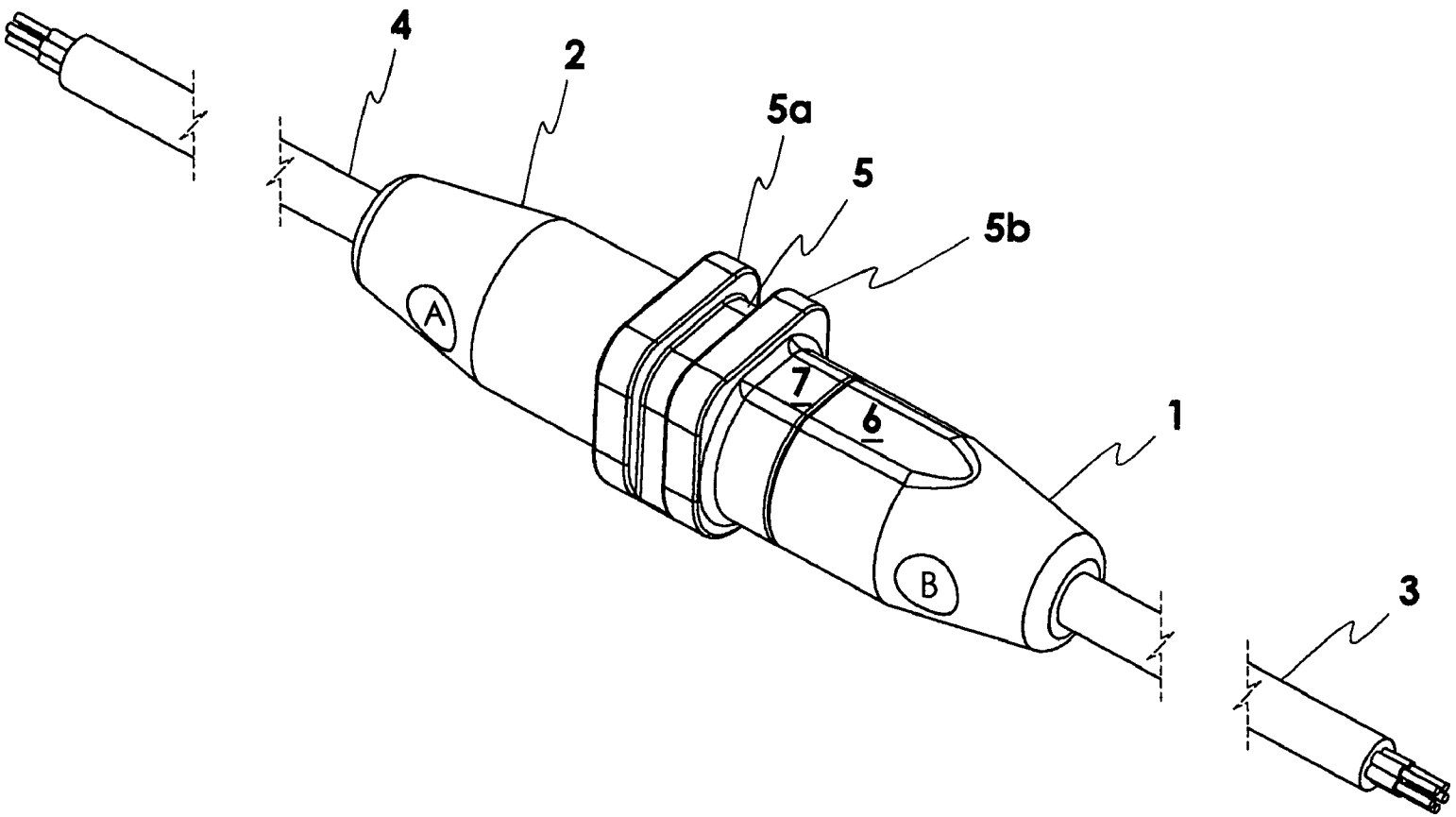
FIG. 1 is a perspective view of a connector of this invention.

Looking now specifically at the drawings that represent the best mode of this invention at the time of filing of this patent application, FIG. 1 is a perspective side view of a connector representing this invention. In this FIG. 1 is the male coupling element (also referred to as the encapsulating gripping element formed longitudinally into a circular body) which encapsulates 3, a cable containing cable or line elements and inserted into 2, the female coupling element (also known as an encapsulating gripping element formed longitudinally into a circular body), which encapsulates 4, another cable containing line elements. In this particular element two ridges 5*a* and 5*b* are shown on the outside of female coupling element 2 along with a gripping groove 5. These are a mounting mechanism which provides a means of securing the connected coupling, not shown in detail in this particular figure. Flat surfaces are provided in this showing as surface 6 on male coupling element 1 and surface 7 of female coupling element 2 to visually aid and help align the couplers when joining. In addition to this exterior flat surface an interior key (not shown herein) may also be included to ensure proper alignment when connecting male coupling element 1 with female coupling element 2 so that the track of that being coupled will be followed maintaining the polarity of cable or line elements 3 to cable or line elements 4. In addition, A and B are shown, the former on the surface of the male coupling element 1 and the latter on the surface of the female coupling element 2. These represent a portion of the pre-mold element within each of the coupling elements (not shown herein) around which the over-mold element representing the outside of these elements are formed during the process of manufacture.

Figure 2:
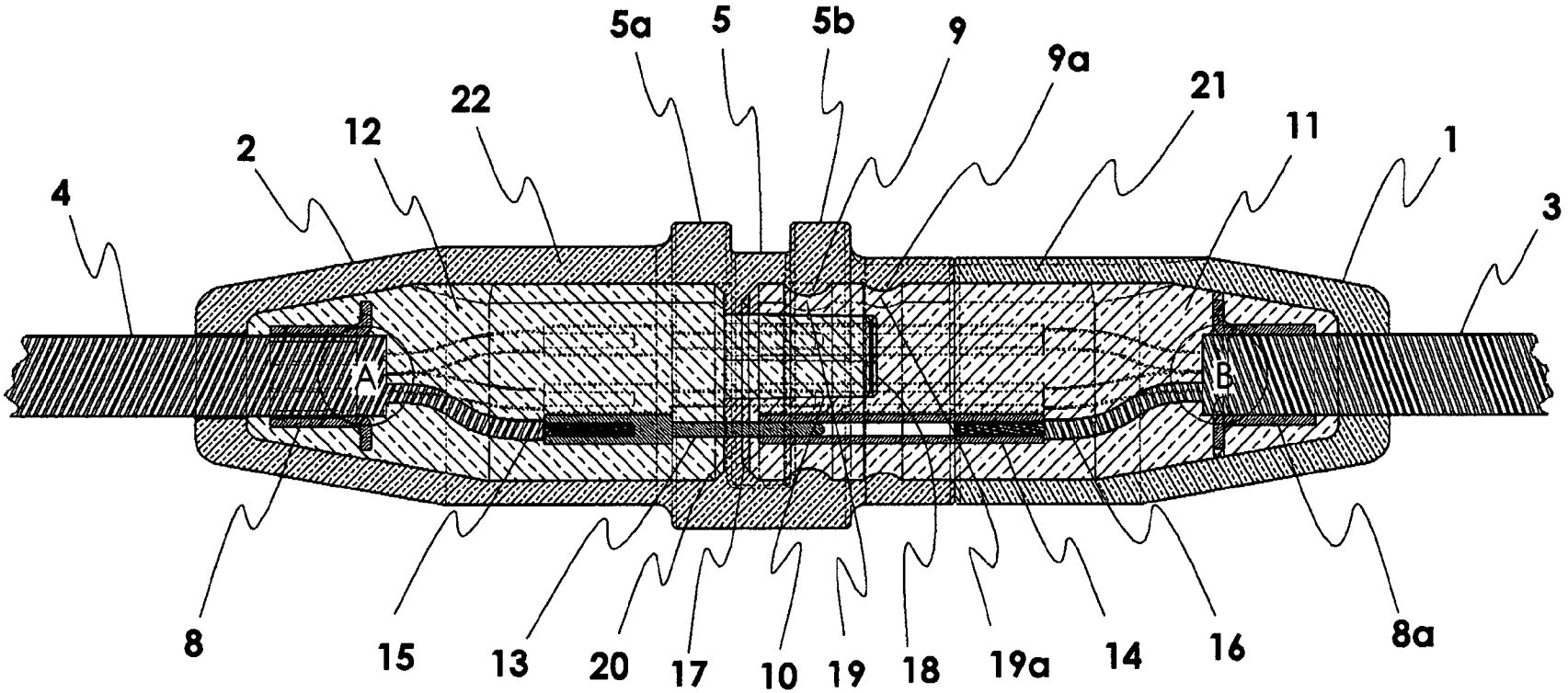
FIG. 2 is a cut-away view of the connector of this invention showing some of the interior detail.

FIG. 2 is a cut-away side view of the coupling element from FIG. 1. In this particular showing one can plainly see the male coupling or gripping element 1 inserted into the female coupling or gripping element 2. Cables or lines 3 and 4 containing at least one wire or other electrical or communication lines and are shown firmly enclosed or encapsulated as inner layers within their respective coupling elements. Emanating from each cable or line are the wires themselves. In this showing one in particular is shown emanating from within male coupling element 1 as 16 and from female coupling element 2 as 15. On the end of wire 15 is a connecting device 13 shown as, but not limited to, a male pin on the female coupling element and designed to mate with female receptacle 14 shown as, but not limited to, a female socket encapsulated in the male coupling element. In this showing the coupling of wires takes place when the connecting pin 13 is firmly placed within the female socket 14. Other wires or communication elements are shown in dotted line throughout the joined coupling elements and they are co-joined in a like manner as described herein. Rings on the female coupling element 2 are shown as 9 and 9*a* and will fit closely into grooves 19 and 19*a* found on the exterior of the male coupling element 1. This matching of rings with grooves provides a tight seal when the coupled elements (male 1 and female 2) are joined to provide initial water resistance and assists in holding these elements in close connection. A flexible outer over-mold portion of each of these elements is shown as 21 and 22 respectfully over inner pre-molded elements 11 and 12. A lip 17 circumferentially located at the second end of male coupling element 1 is also shown. In this showing lip 17 of male coupling element 1 is pressed into face 20 of the female coupling element by the normal force of connecting male coupling element 1 with female coupling element 2 and provides the final, highly moisture resistant seal. When this arrangement is put together, one can plainly see that the totality of sealing elements within this device will ensure not only a tight fit so as to join wires and other cabling elements but also to encapsulate the elements so as to form a highly moisture resistant seal. Both male coupling or gripping element 1 and female coupling or gripping element 2 are formed as hollow, flexible, circular sleeves for containing the elements shown within.

Figure 3:
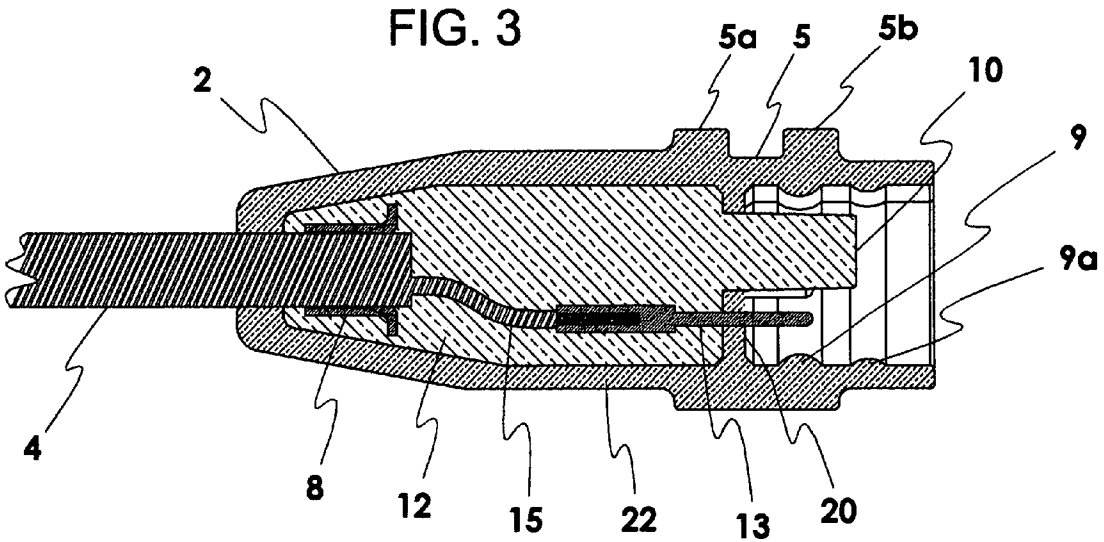
FIG. 3 is a detailed showing of the female coupling element of this invention.

In FIG. 3 we can see some additional detail taken from FIG. 2. In this particular showing only the female portion of FIG. 2 is shown and has been enlarged. Here we can clearly see the rings of the female coupling element 2 shown as 9 and 9*a*. In addition to the wire connections 13 and 15 a keying feature 10 is shown. This key ensures that, in case of polarity sensitive applications, the correct connection is made between the male 1 and female 2 coupling elements. Additional wires, electrical and communications connections may be included but are not shown in this figure.

Figure 3A:
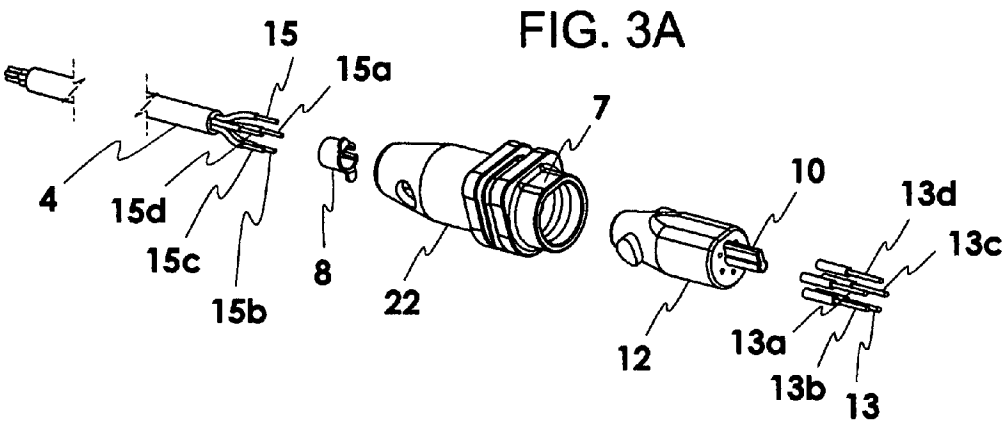
FIGS. 3A and 4A are exploded versions of FIGS. 3 and 4.

In FIG. 3A we see an exploded view of the female coupling element 2 including several other wire connections that might be included, if needed, when coupled with male coupling element 1 (which is not shown in this figure).

Figure 4:
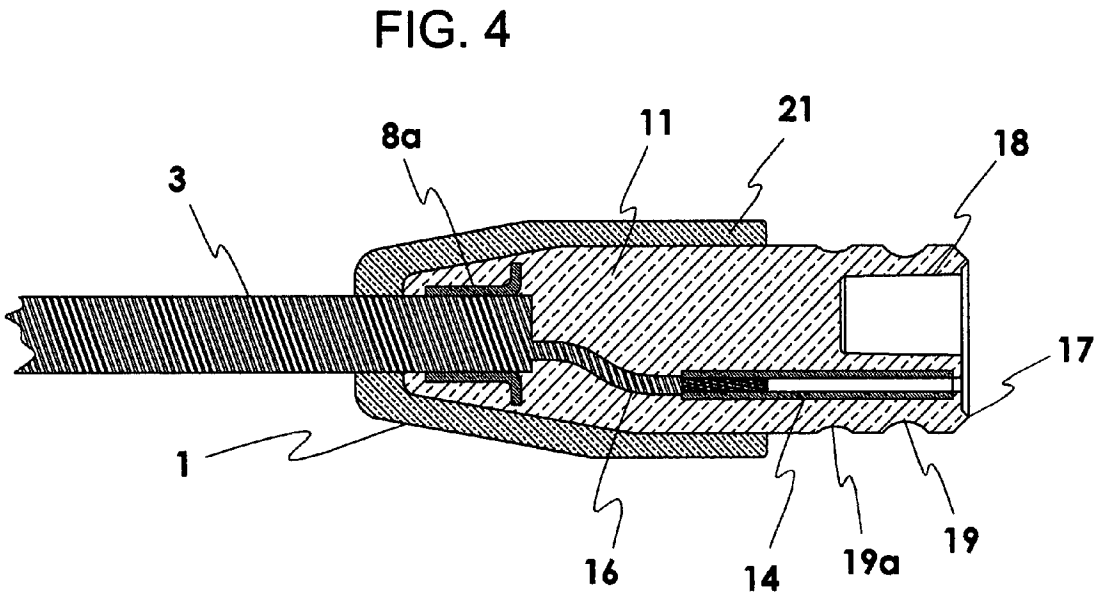
FIG. 4 is a detailed showing of the male coupling element of this invention.
Figure 4A:
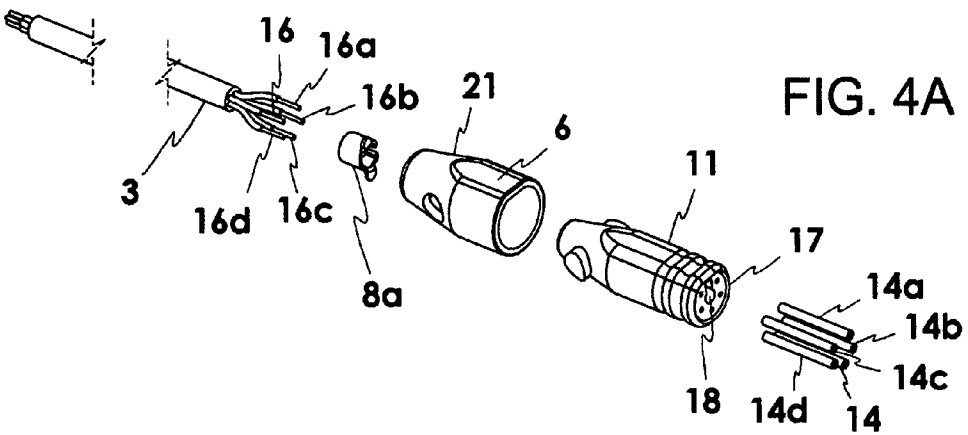

FIG. 4 is a cut-away showing of the male coupling element and FIG. 4A is an exploded view of FIG. 4 with additional wire connections that might be included, if needed. In FIG. 4 a receptacle 18 for key 10 found on female coupling element 2 (not shown in this figure) is shown along with female receptacle 14 and wire 16, this wire emanating from line 3. Grooves 19 and 19*a* that will make contact and seal with rings 9 and 9*a* of the female coupling element (also not shown in this figure) and along with lip 17 provide the highly moisture resistant seal when male coupling element 1 is mated with the female coupling element 2 of this invention.

FIG. 4A is an exploded view of FIG. 4 showing the various parts as they are placed within the male coupling element 1. Looking closely at this view one can see that cable 3 contains multiple lines seen as wires and shown as 16 and 16*a-d*. These are connected to receptacle 14 and 14*a-d* and housed in the male coupling element 1 in a manner shown in FIG. 4 and terminates at the end near lip 17.

Figure 5:
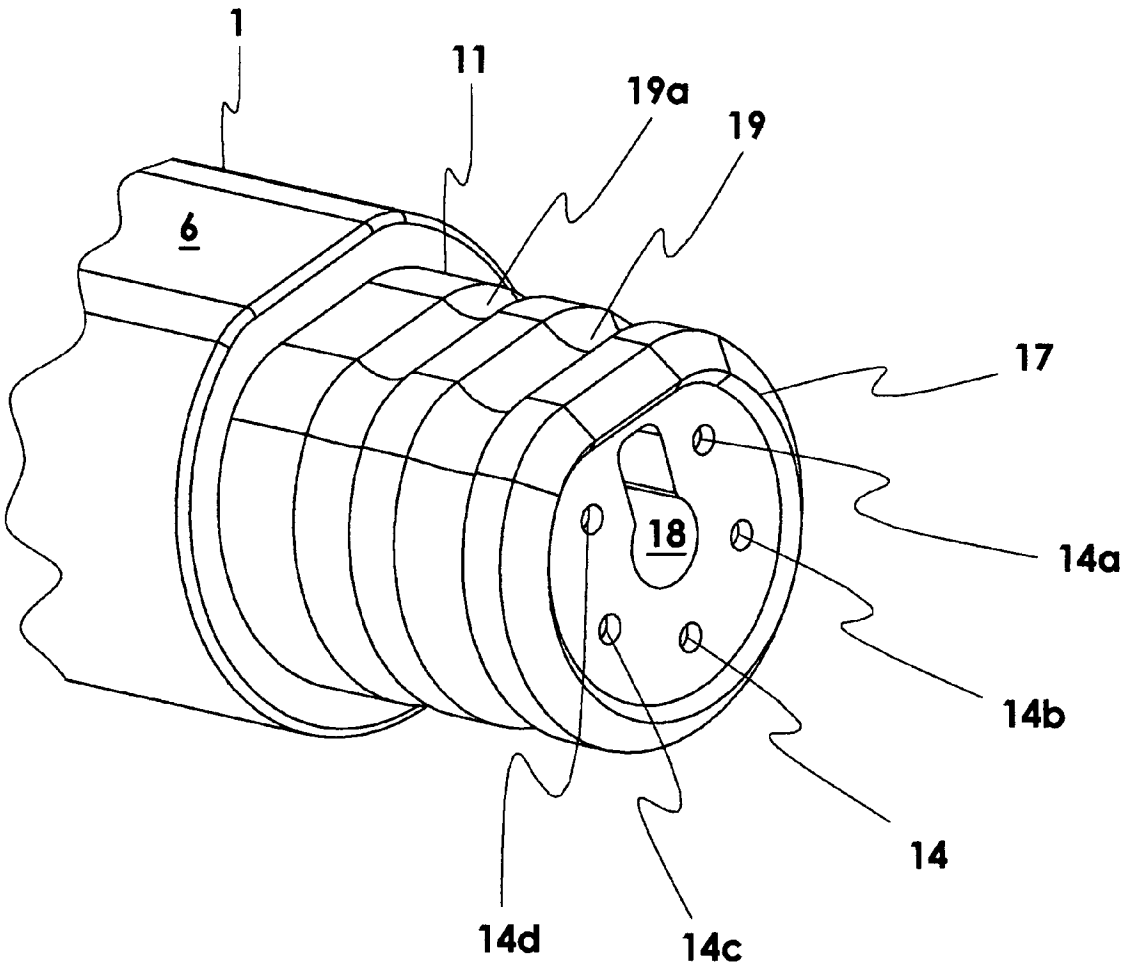
FIG. 5 is an enlarged showing of the male coupling element.

FIG. 5 is an enlarged perspective showing of the tip of the male coupling element from FIG. 4. All of the parts from FIGS. 1-4 are labeled as described above. At the very end, one can clearly see lip 17 which surrounds the end and female receptacle 14 shown along with four (4) other female receptacles 14*a-d*.

Figure 6:
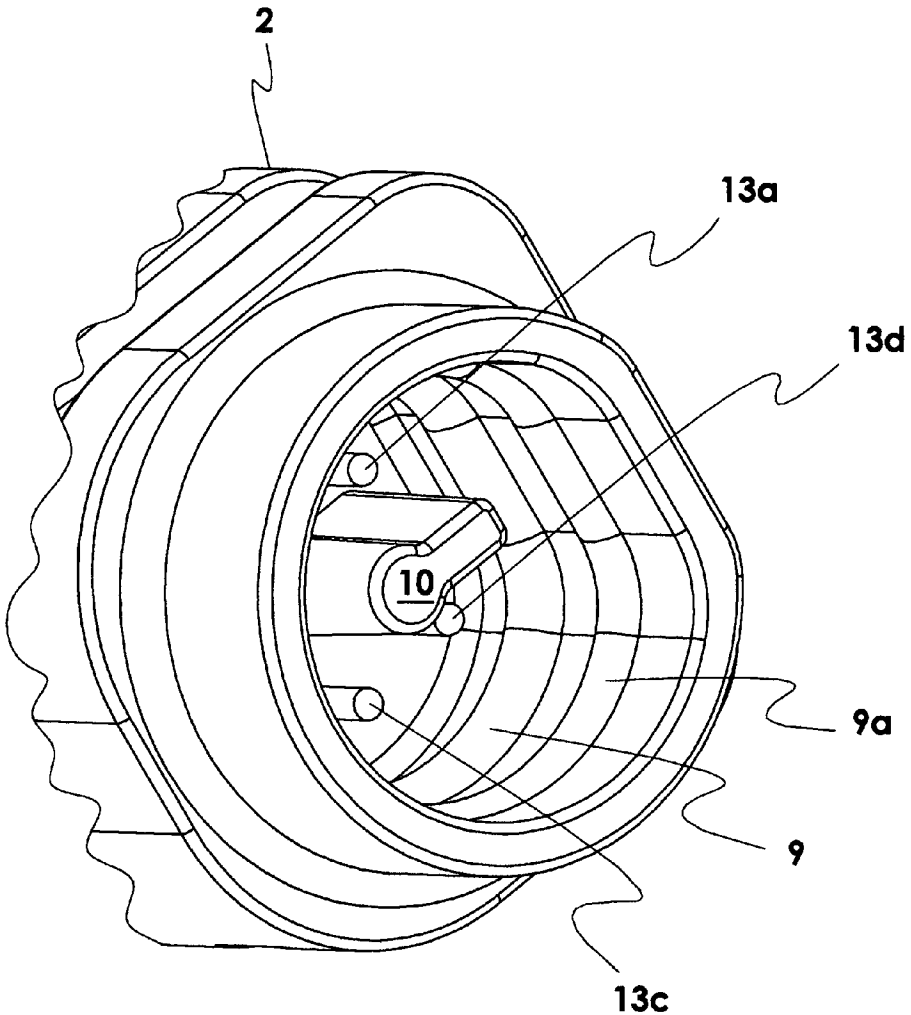
FIG. 6 is an enlarged showing of the female coupling element.

FIG. 6 is an enlarged perspective showing of the receptive end of the female coupling element from FIG. 3. All of the parts described hereto are labeled in the same manner. The key is shown as 10 and one of the male connection points designed to mate with female receptacle 14*d* (as shown in FIG. 5) on the male coupling element is shown as 13*d*. Two other male connecting points are shown as 13*a* and 13*c*.

Figure 7:
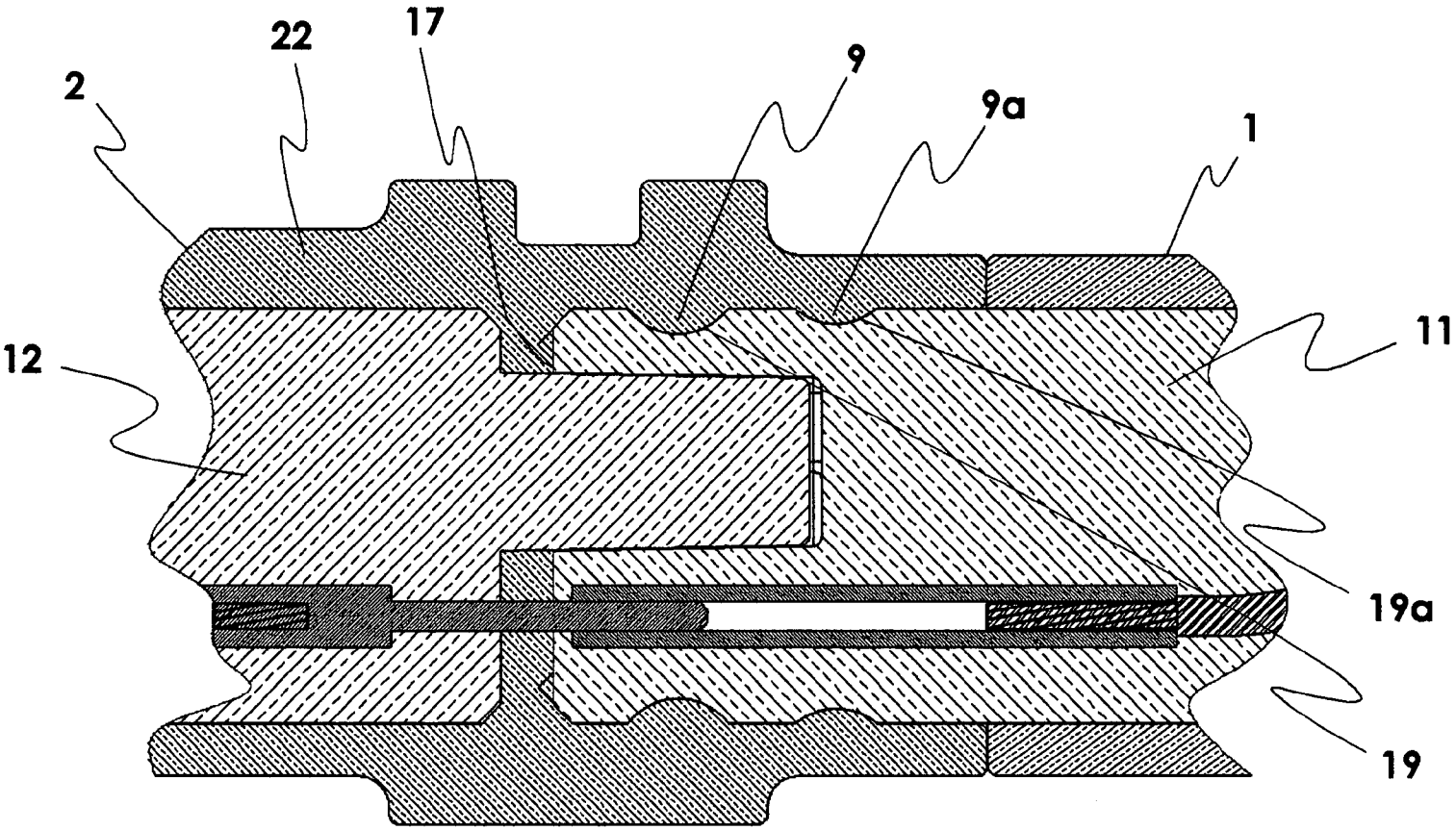
FIG. 7 is an enlarged view of the male coupling element from FIG. 5 engaged with the female coupling element of FIG. 6.

FIG. 7 is an enlarged detail showing of the mated male coupling element 1 and female coupling element 2 from FIG. 2. Connections are made within the coupled ends and are not shown clearly in this figure. The lip 17 of the male coupling element 1 securely pressed into face 20 of female coupling element 2 and the rings 9 and 9*a* of the female coupling element 2 will ensure a tight, highly moisture resistant connection so that communications and electrical connections, among others, can be transmitted along the line securely, uninterrupted and free of moisture caused failures.

The high moisture resistance of the coupling device of this invention represents a significant improvement over any of the prior art. My device can be manufactured easily and at a reasonable cost and perform well in advance of any of the prior art coupling elements. Preferred materials of construction include, but are not necessarily limited to, polymers that can be molded following the procedures of injection molding, for example, to form rigid or flexible elements. Rigid element materials might include (but are not limited to) polymers such as polypropylenes or nylons while flexible element material might include (but not limited to) thermoplastic elastomers such as thermoplastic rubbers or polyurethanes. The materials of construction of the internal element shown in FIG. 2 may include, but are also not limited to, gold plated brass receptacle shown as 14 mated with a gold plated brass pin shown as 13. A pair of brass wing-bands 8 and 8*a* are shown crimped to cables 3 and 4 for the purpose of providing increased pull strength to the overall construction. Thus, the element described in this invention can be easily pulled apart by gripping the male coupling element 1 and the female coupling element 2 and simply pulling apart to disconnect the two ends formed within this system. All of the internal components (11 and 12 of the male and female coupling elements respectively) are shown encapsulated within rigid polymeric materials of construction of this device.

Preferred uses for the coupling elements of this invention are for electrical and communication systems, where moisture resistance is extremely critical for the proper function and longevity of these attached coupling elements. Typically, the attached coupling elements might be used in the medical equipment art field where protection from various types of fluids is paramount and where critical sterilization methods are employed ranging from simple antiseptic spraying to more aggressive autoclaving methods. Other uses might include the communications field both commercial and military, particularly where these elements are used in a hostile environment that might cause failures by corrosion due to moisture infiltration, for example. Still other uses might be in the automotive and shipboard equipment field, both commercial and military. One use contemplated within the metes and bounds of this invention includes use as an accessory application for shipboard equipment. Here, the equipment includes power and communication connections where moisture failures are a typical, normal and ongoing concern. Thus, employing the highly moisture resistant coupling elements of this invention would be highly advantageous for this and similar applications.

Looking now carefully at the drawings again, one can easily see how the various parts of the female and male coupling elements are mated together in a manner so as to provide intimate contact and high moisture resistance. In FIGS. 3 and 4 and in 3A and 4A, the various parts can be seen in detail. For example, in FIG. 3, the female coupling element 2 is seen in its entirety completely assembled and ready to receive the male coupling element 1. The entire female coupling element 2 is seen in detail in FIG. 3A with the various parts envisioned within the metes and bounds of this invention. In FIG. 4 the male coupling element 1 is seen with its parts disclosed and further exemplified in FIG. 4A. In FIG. 2, the two coupling elements are firmly mated and all of the connections are made within the confines of the outside of these two parts. The male coupling element 1 contains at least one pair of grooves manufactured circumferentially around element 11 and shown as 19 and 19*a*. These grooves, when inserted into female coupling element 2 mate with a pair of rings manufactured into the inside of that element ensuring an excellent moisture tight seal. Added further to the system is a rigid lip manufactured into the very end of the male coupling element, so that when the male and female elements are coupled together the rigid lip of the male element presses into the flexible face of the female element to ensure the final highly moisture resistant seal. All of the internal wires or conduits and the like are contained fully within the core of this device and since moisture cannot penetrate this core they remain moisture free and secure. All of these elements are manufactured directly into the fabric of the element as it is being manufactured. In the preferred embodiment shown in FIG. 3, the portion of element 2 which contains sealing rings 9 and 9*a* and surrounds key feature 10 and pin 13, for example, also serves to protect these elements from incidental damage when the connector system is disconnected.

The parts for the elements of this invention are easily manufactured to specifications and then molded, producing the male and female coupling elements. Referring again to FIG. 2, I prefer a process whereby pin 13 is attached to wire 15 and socket 14 to wire 16, for example, by crimping or soldering. Wing-band 8 is attached to cable 4 and wing-band 8*a* to cable 3 also incorporating a crimping process. This crimping can be adjusted to a specific crimp height as desired to meet a particular or desired pull force specification set for the particular coupler system. The cable assemblies may then be molded, for example, first with a rigid polymer, commonly referred to in the molding field as pre-molded, and then with a flexible, thermal plastic elastomer as previously described herein, commonly referred to in the molding field as an over-molding. This molding process fully encapsulates the cable assembles sealing them from moisture penetration via the cable ends of the coupling elements. When the male and female coupling elements are then connected, the entire joint is rendered highly moisture resistant with the ability to disconnect and reconnect as desired with the highly moisture resistant seal repeating with each reconnection. No other element described within the prior art has such an easily manufactured element nor can they provide the ease of connection and reconnection while maintaining a high level of moisture resistance.

I claim:

1. A highly moisture resistant flexible coupler system having two coupling elements therein comprising;

a. a first male coupling element formed in a longitudinal end-to-end formation and having an energy transmitting line element contained and encapsulated therein, comprising in order a first end comprising said line for transmitting said energy, an encapsulated gripping element and a second end formed longitudinally into a circular body, said circular body comprising an outer layer and an encapsulating inner layer, at least one female receiving element being encapsulated longitudinally in said circular body, said female receiving element having two ends, one of said ends being connected to said energy transmitting line and the other of said ends being connected to a face ended on said circular body, wherein a rigid lip is formed circumferentially on said face, and wherein the outer layer of said circular body has at least two grooves formed circumferentially thereon;

b. a second female coupling element formed in a longitudinal end-to-end formation and having an energy transmitting line element contained and encapsulated therein, comprising in order a first end and a second end, said first end having a hollow, flexible, circular sleeve, circumferentially containing at least one longitudinal male connecting element, said flexible, circular sleeve formed in a manner so as to receive said circular body from said male coupling element, and having at least two rings formed circumferentially inside around said male connecting element, said male connecting element longitudinally forming a face adjacent to a second energy transmission line encapsulated in a second gripping element and forming said second end;

so that when said circular body from said male coupling element is inserted in said circular sleeve from said female coupling element, said male connecting element in said female coupling element fits within said female connecting element in said male connecting element, said rings of said female connecting element fits within said grooves in said male connecting element and said face of said female connecting element firmly contacts and seals said rigid lip of said face of said male connecting element and energy transmission is completed from said male to said female connecting element.

2. The highly moisture resistant coupling system of claim 1 where in said energy transmission is a communications system comprising at least one communication cable located within each of said male and female coupling elements, each of said cables having at least one wire therein, whereby said wire in said male coupling element has a female socket thereon and the wire in said female coupling element has a male pin thereon, and said socket and said pin are encapsulated within said coupling elements, so that when said male coupling element is mated to said female coupling element a communication line is formed by the mating of said pin to said socket.

3. The highly moisture resistant coupling system of claim 1 where said energy transmission is an electrical system comprising at least one electrical cable located within each of said male and female coupling elements, each of said cables having at least one wire therein, whereby said wire in said male coupling element has a female socket thereon and the wire in said female coupling element has a male pin thereon, and said socket and said pin are encapsulated within said coupling elements, so that when said male coupling element is mated to said female coupling element an electrical line is formed by the mating of said pin to said socket.

4. The highly moisture resistant coupling system of claim 1 wherein said encapsulation of said male connection point comprises a rigid polymer.

5. The highly moisture resistant coupling system of claim 1 wherein said encapsulation of said female connection point comprises a flexible polymer sleeve.

6. The coupling system of claim 1 where in said male coupling element can be disconnected from and subsequently reconnected back to said female coupling element while maintaining said moisture resistance.

7. The coupling system of claim 1 wherein said encapsulated gripping elements of both said male and said female coupling elements comprise rigid polymers.

* * * * *

UNITED STATES PATENT AND TRADEMARK OFFICE

CERTIFICATE OF CORRECTION

PATENT NO. : 7,275,949 B1
APPLICATION NO. : 11/638233
DATED : October 2, 2007
INVENTOR(S) : Theodore J. Speaker, IV It is certified that error appears in the above-identified patent and that said Letters Patent is hereby corrected as shown below:

On the Title page, Item (73) Assignee now reads: Whitney Blake Company, Bellows Falls, UT (USA)" and should read:

Item (73) -- Whitney Blake Company, Bellows Falls, VT (USA) --

Signed and Sealed this

Twenty-third Day of November, 2010

David J. Kappos

David J. Kappos
*Director of the United States Patent and Trademark Office*